US007305975B2

(12) United States Patent
Reddy

(10) Patent No.: US 7,305,975 B2
(45) Date of Patent: Dec. 11, 2007

(54) EVAP CANISTER PURGE PREDICTION FOR ENGINE FUEL AND AIR CONTROL

(76) Inventor: Sam R. Reddy, 4620 Wendrick Dr., West Bloomfield, MI (US) 48323

( * ) Notice: Subject to any disclaimer, the term of this patent is extended or adjusted under 35 U.S.C. 154(b) by 224 days.

(21) Appl. No.: 10/831,734

(22) Filed: Apr. 23, 2004

(65) Prior Publication Data

US 2005/0240336 A1 Oct. 27, 2005

(51) Int. Cl.
*F02M 33/02* (2006.01)
*F02M 33/00* (2006.01)

(52) U.S. Cl. ..... 123/520; 123/518

(58) Field of Classification Search ..... 123/520, 123/518, 519, 516, 198 D; 73/119 A, 118.1, 73/118.2

See application file for complete search history.

(56) References Cited

U.S. PATENT DOCUMENTS 5,531,359 A 7/1996 Winner ..... 222/153.11
5,560,347 A 10/1996 Reddy et al.
5,570,817 A 11/1996 Anderson et al. ..... 222/153.11
5,676,118 A * 10/1997 Saito ..... 123/679
5,727,537 A * 3/1998 Nakagawa et al. ..... 123/698
D404,562 S 1/1999 Brown et al. ..... D3/215
5,909,727 A * 6/1999 Nakagawa ..... 123/520
6,098,601 A 8/2000 Reddy
6,112,961 A 9/2000 Phillips ..... 224/222
6,279,548 B1 8/2001 Reddy
6,615,827 B2 9/2003 Greenwood et al. ... 128/200.23
2003/0141325 A1 7/2003 Balogh, II ..... 224/101

OTHER PUBLICATIONS

Sultan, Myrna C. et al., Closed Loop Canister Purge Control System, SAE Technical Paper Series, #980206, Int'l Congress and Expo, Feb. 1998, pp. 1-8.

* cited by examiner

*Primary Examiner*—Mahmoud Gimie

(57) ABSTRACT

In a system and a method for purging a vapor storage canister having adsorbed fuel vapor (or hydrocarbon vapor) by drawing air through the storage canister the storage canister being coupled with an engine having a system for controlling the amount of fuel provided to the engine, the amount of fuel vapor in the purge is estimated using a model that predicts fuel vapor concentration in the purge vapor. The engine controller uses the estimated amount of fuel vapor and air brought into the engine from the evaporative vapor storage canister for better control of engine air and fuel during purging.

16 Claims, 4 Drawing Sheets

EVAP CANISTER PURGE PREDICTION FOR ENGINE FUEL AND AIR CONTROL

FIELD OF THE INVENTION

The present invention relates generally to systems and methods connected with vapor storage canisters. In particular, the present invention concerns estimating hydrocarbon vapor and air drawn into an engine from purge of an evap canister and using the estimate for engine air and fuel control.

BACKGROUND OF THE INVENTION

The automotive industry has actively sought improved emissions reduction, including reduction in emissions due to gasoline evaporation. Gasoline includes a mixture of hydrocarbons ranging from higher volatility butanes ($C_4$) to lower volatility $C_8$ to $C_{10}$ hydrocarbons. When vapor pressure increases in the fuel tank due to conditions such as higher ambient temperature or displacement of vapor during filling of the tank, fuel vapor flows through openings in the fuel tank. To prevent fuel vapor loss into the atmosphere, the fuel tank is vented into a canister called an "evap canister" that contains an adsorbent material such as activated carbon granules.

As the fuel vapor enters an inlet of the canister, the fuel vapor diffuses into the carbon granules and is temporarily adsorbed. The size of the canister and the volume of the adsorbent material are selected to accommodate the expected fuel vapor generation. One exemplary evaporative control system is described in U.S. Pat. No. 6,279,548 to Reddy, which is hereby incorporated by reference. After the engine is started, the control system uses engine intake vacuum to draw air through the adsorbent to desorb the fuel. An engine control system may use an engine control module (ECM), a powertrain control module (PCM), or other such controller to optimize fuel efficiency and minimize regulated emissions. The desorbed fuel vapor is directed into an air induction system of the engine as a secondary air/fuel mixture to consume the desorbed fuel vapor. To optimize fuel efficiency it is desirable to take this secondary air/fuel source into account. Presently, however, canister purge fuel and air are not metered, and so the ECM has no data to use in adjusting the fuel and air to the engine. Exhaust oxygen sensor feedback control is used to adjust fuel control during canister purge. Feedback control, as it is after the fact, is not very effective in exhaust emissions control. Stringent exhaust emission regulations, however, require ever more careful control of the air/fuel ratio in the engine. On the other hand, more stringent evap emissions regulations require increased purge air rates, meaning even more un-metered air entering the engine.

Additionally, the amount of adsorbed fuel vapor in the canister varies during the desorption process. The rate at which fuel vapor is drawn from the canister will decrease as more and more is removed until finally all of the fuel will have been desorbed from the canister. It would be desirable to enable the engine or powertrain control module ("controller") to take into account the amount of fuel vapor drawn from the storage container in optimizing fuel efficiency and minimizing emissions and to be able to adjust for the decrease in fuel vapor from the storage canister as the adsorbed fuel is depleted.

One way to provide to the controller the information of fuel vapor and purge air drawn from the storage container would be to measure directly the amount of hydrocarbon and air being drawn from the storage canister using a purge hydrocarbon sensor so that the engine controller can reduce the fuel from the fuel tank injected into the engine and air intake of the engine accordingly. This approach will result in feed forward control that is very effective in exhaust emission control, but would require adding an expensive purge sensor to the engine.

It would thus be useful to have a method of predicting the amount of hydrocarbon in the air drawn through the canister into the engine for better feed forward fuel control without adding expensive equipment to the engine.

SUMMARY OF THE INVENTION

The present invention provides a method and an apparatus for controlling the engine air and fuel ratio during purging of an evaporative vapor storage canister. The apparatus includes a controller programmed to use a calculation to estimate the amount of hydrocarbon and air in purge vapor from an evaporative vapor storage canister to reduce the amount of metered fuel and air entering the engine.

The canister contains adsorbent material capable of adsorbing fuel vapor from a fuel tank storing a volatile fuel. The canister includes a vapor inlet coupled to the fuel tank, a purge outlet coupled to an air induction system of an engine, and fuel vapor generated in the fuel tank from diurnal and refueling events that is stored in the canister. During purging, the air induction system draws air through the canister. Desorbed fuel vapor (also referred to herein as hydrocarbon vapor) enters the air as it is drawn through the canister. The hydrocarbon vapor in the withdrawn hydrocarbon vapor/air mix will decrease through the purging operation. The initial concentration of desorbed hydrocarbon vapor in the purge vapor, if not known, may be estimated from relevant factors such as the fuel level change since the last purge, the interval of time since refueling (i.e., since increasing the fuel level), ambient temperature, seasonal RVP of the fuel, and the adsorption capacity and quantity of the adsorbent in the evaporative vapor storage canister.

The controller calculates the amount of hydrocarbon and air in purge vapor from an evaporative vapor storage canister using an estimate or determination of initial concentration of hydrocarbon vapor in the purge and an equation that predicts the decrease with time of the amount of hydrocarbon in the purge from the evaporative vapor storage canister. The equation is preferably based on Langmuir adsorption isotherm equations.

The invention further provides a method for purging a vapor storage canister having adsorbed fuel (or hydrocarbon) vapor coupled with an engine having a system for controlling the amount of fuel provided to the engine, e.g. an electronic engine control module. In the method, the amount of fuel vapor and air in the purge is estimated using an estimate or determination of initial concentration of hydrocarbon vapor in the purge an equation that predicts the decrease with time of the amount of hydrocarbon in the purge from the evaporative vapor storage canister. The equation is preferably based on Langmuir adsorption isotherm equations. An initial concentration of hydrocarbon vapor in the purge air may be measured or estimated based on known factors such as engine temperature, time since refueling, seasonal RVP of the fuel, and the adsorption capacity and quantity of the adsorbent in the evaporative vapor storage canister. An ECM or PCM uses the calculation of fuel vapor flow from the canister during purging to improve fuel efficiency and/or reduce exhaust emissions.

The amount of fuel drawn from the fuel tank and/or intake air can be reduced by the known amount of fuel vapor and air in the purge stream.

In a further embodiment, when an engine starts and purging of the canister starts the initial concentration of hydrocarbons in purge vapor is determined or is estimated from how much vapor may be stored in the canister based on indicators of time since the engine was last on and how hot the canister is (e.g., whether heated by heat released from vapor adsorption during refueling). Next, decrease of hydrocarbon vapor in the purge vapor is determined using an equation. The equation may be modeled from Langmuir adsorption isotherm equations.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

In describing the present invention, "engine control module," "ECM," "powertrain control module," "PCM," and "controller" are used interchangeably to refer to a control module that can adjust the amount of fuel and air provided to the engine.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
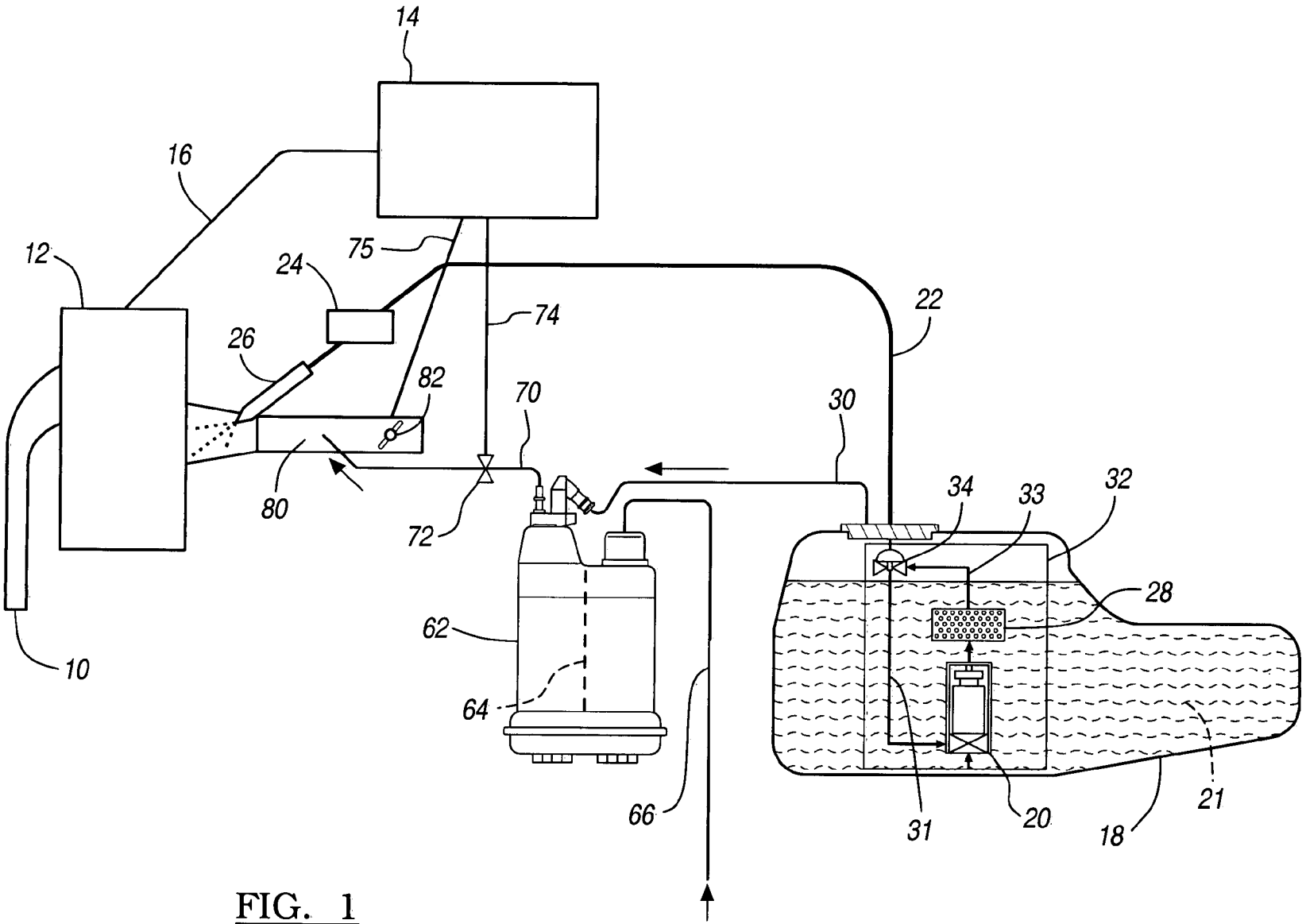
FIG. 1 is a functional block diagram of an engine and evaporative control system for a vehicle.

Referring now to FIG. 1, an engine 12 having an intake manifold 80 and exhaust manifold 10 is illustrated. The vehicle may be a conventional (non-hybrid) vehicle including an internal combustion engine or a hybrid vehicle including an internal combustion engine and an electric motor (not shown). The engine 12 is preferably an internal combustion engine that is controlled by a controller 14. The engine 12 typically burns gasoline, ethanol, and other volatile hydrocarbon-based fuels. The controller 14 may be a separate controller or may form part of an engine control module (ECM), a powertrain control module (PCM), or another vehicle controller.

When the engine 12 is started, the controller 14 receives signals from one or more engine sensors, transmission control devices, and/or emissions control devices. Line 16 from the engine 12 to the controller 14 schematically depicts the flow of sensor signals. During engine operation, gasoline 21 is delivered from a fuel tank 18 by a fuel pump 20 through a filter 28 and fuel lines 33 and 22 to a fuel rail (not shown). Fuel injectors inject gasoline into cylinders of the engine 12 or to ports that supply groups of cylinders. FIG. 1 shows one such fuel injector 26. The timing and operation of the fuel injectors and the amount of fuel injected are managed by the fuel controller 24. Fuel controller 24 is controlled by controller 14 (control line not shown). Air controller 82 in intake manifold 80 manages the amount of air entering engine 12 and is also controlled by controller 14 by control line 75.

The fuel tank 18 is often made of blow-molded, high-density polyethylene provided with one or more gasoline impermeable interior layer(s). The fuel tank contains a fuel sender module 32. Fuel pump 20 pumps gasoline 21 through filter 28 and fuel line 33 to pressure regulator 34, where the unused fuel is returned to the tank. By-pass line 31 returns unused gasoline to the fuel pump inlet.

The fuel tank 18 includes a vent line 30 that extends from the fuel tank 18 to a fuel vapor adsorbent canister 62. Fuel vapor pressure increases as the temperature of the gasoline increases. Vapor flows under pressure through the vent line 30 to the fuel vapor adsorbent canister 62. The vapor enters the canister 62 and is captured by suitable adsorbent material (not shown), such as activated carbon materials, on either side of a center wall 64. The fuel vapor adsorbent canister 62 is formed of any suitable material. For example, molded thermoplastic polymers such as nylon are typically used. After the fuel vapor is adsorbed in the canister, the air exits through vent line 66.

Vent line 66 provides air during purging of adsorbed fuel vapor from the canister 62. A stream of purge air and fuel vapor exit the canister through the purge line 70. The purge line 70 contains valve 72 that selectively closes the canister 62 off from engine 12. Purge valve 72 is operated by the controller 14 through a signal lead 74 when the engine 12 is running. Purge valve 72 is closed when the engine 12 is not operating, but is opened after the engine 12 warms up when the engine 12 is operating for purging adsorbed vapor. Purge flow is controlled by ECM 14 by pulse width modulation (PWM) of purge valve 72. For example, purge flow is reduced during idle and/or when the purge vapor has a high concentration of hydrocarbon. The air becomes laden with desorbed hydrocarbon fuel vapor desorbed from canister 62. The fuel-laden air is drawn through the purge line 70 and into intake manifold 80. Controller 14 estimates the amount of fuel vapor in the purge air from purge line 70 and adjusts both the amount of fuel injected into the engine and air taken into the engine by the fuel controller 24 and the air controller 82 using a model that predicts the change in hydrocarbon concentration as a function of controller-commanded purge volume.

Figure 2A:
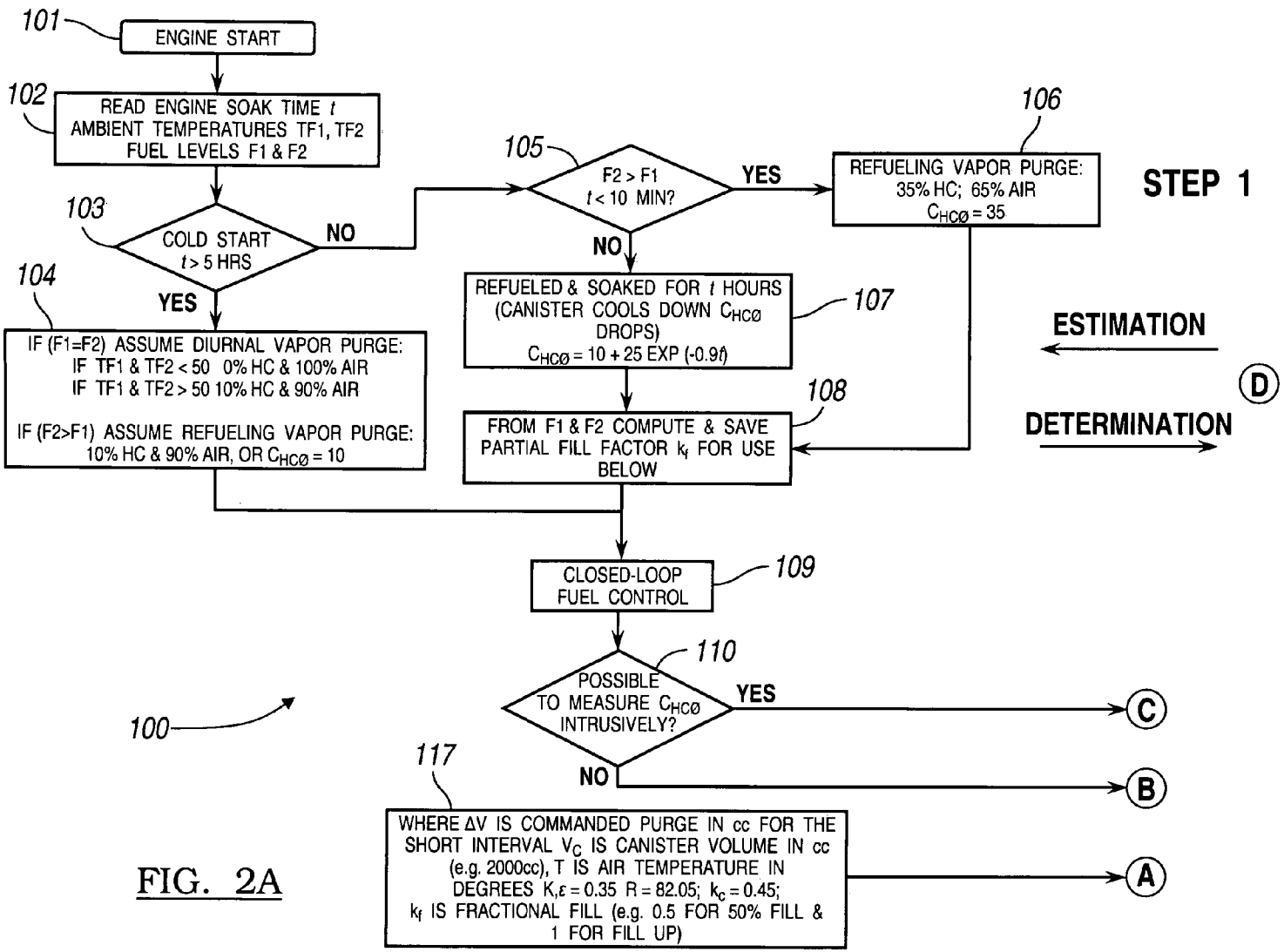
FIGS. 2A and 2B together are a flow chart illustrating the steps by which the vehicle controller estimates the amount of fuel vapor in the purge from the evaporative vapor storage container.
Figure 2B:
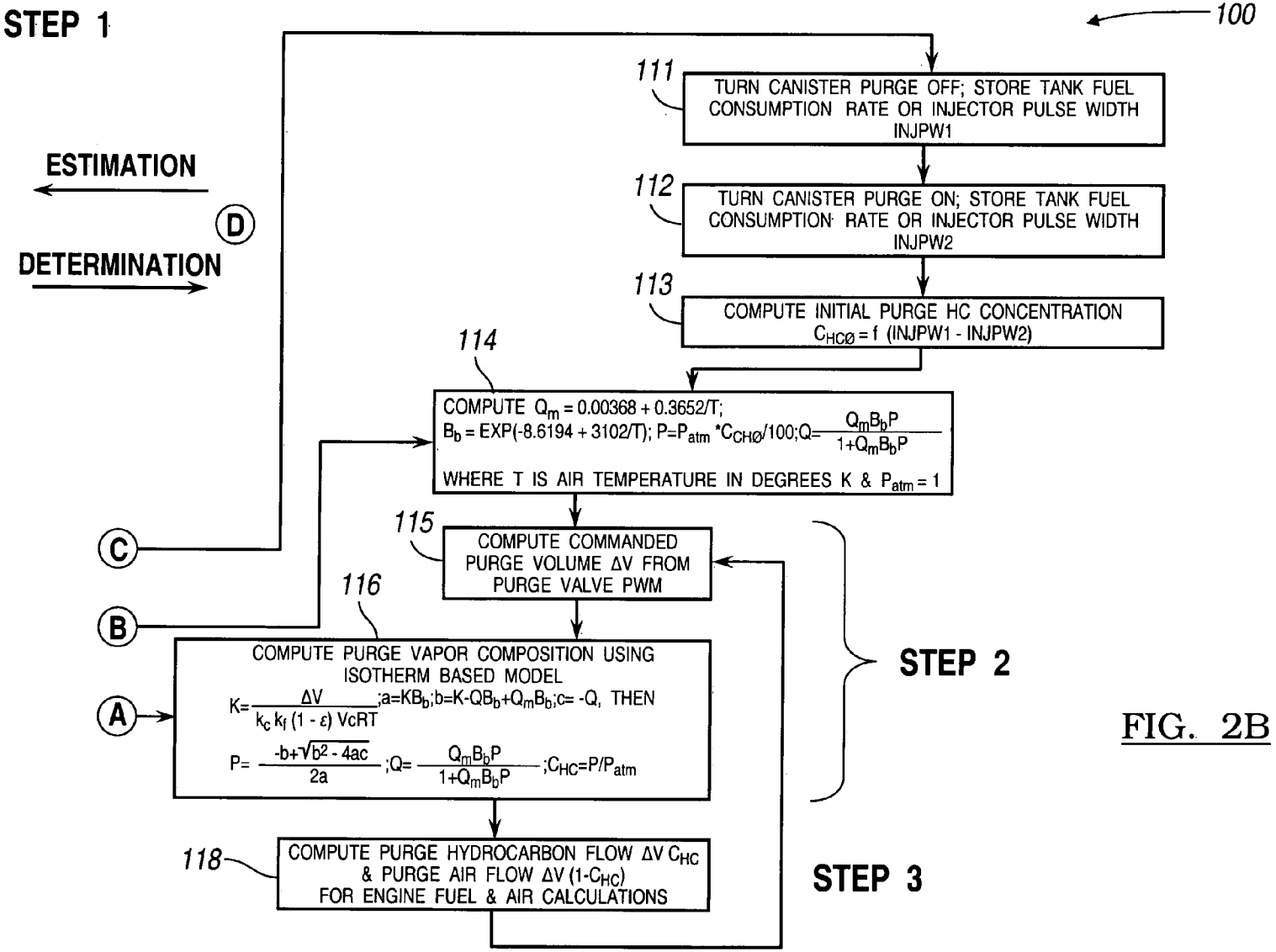

The controller uses an algorithm that may have three major steps. In a first step, the controller determines the status of the canister to estimate how much vapor is stored and how hot the canister is. The canister may be heated from refueling vapor adsorption heat release. Alternatively, an actual measurement of initial hydrocarbon concentration in the purge vapor may be made. In an embodiment illustrated in FIGS. 2A and 2B, steps 102–109 are used for estimating initial hydrocarbon concentration in the purge vapor; steps 111 to 113 are used for determining actual initial hydrocarbon concentration in the purge vapor. In a second major step, the controller computes the decrease in hydrocarbon concentration in the purge vapor as the engine draws air through the canister. In FIGS. 2A and 2B, steps 114 to 117 represent this computation. In a third major step, using purge vapor volume and concentration of hydrocarbon vapor in the purge vapor, the amounts of purge hydrocarbon vapor and air are used by the controller in engine air and fuel calculations to determine an amount of fuel to be taken from the fuel tank and an amount of intake air for improved fuel efficiency and exhaust emission control. This is step 118 of algorithm 100 in FIG. 2B. (The individual steps of algorithm 100 of FIGS. 2A and 2B are described in more detail below.)

The model for predicting change in hydrocarbon concentration as a function of controller-commanded purge volume may use an initial hydrocarbon concentration that is estimated from purge canister and/or vehicle conditions or may use an initial hydrocarbon concentration that is measured. An initial hydrocarbon concentration in purge vapor may be estimated based on factors such as the fuel level change since the last purge, the interval of time since refueling (i.e., since increasing the fuel level), ambient temperature, seasonal RVP of the fuel, and the adsorption capacity and quantity of the adsorbent in the evaporative vapor storage canister.

An initial hydrocarbon concentration in purge vapor may be measured by monitoring the fuel injection rate with and without canister purge at steady state engine operation.

The controller then uses the initial hydrocarbon concentration (predicted or measured) and a model to estimate hydrocarbon concentration in the purge vapor as a function of commanded purge vapor volume. In one embodiment, a suitable model can be made by fitting a curve to experimentally measured values for hydrocarbon concentration in the purge vapor as a function of commanded purge vapor volume for a specific vehicle, purge canister, absorbent, and purge conditions. In another embodiment, a model may be of a form that predicts exponential decrease for hydrocarbon concentration in the purge vapor from the initial hydrocarbon concentration with continuing purge. In this embodiment, the concentration of hydrocarbon in the purge vapor, $C_{HC}$, may be estimated from an equation:

$$C_{HC}=C_{HC0}\mathrm{EXP}(-((\alpha C_{HC0}+\beta)V), \text{ in which}$$

V is the cubic feet of commanded purge volume;

$C_{HC0}$ is the initial concentration of hydrocarbon vapor in the purge;

$C_{HC}$ is the concentration of hydrocarbon vapor in the purge after V cubic feet of commanded purge volume; and $\alpha$ and $\beta$ are constants, the values of which depend on the particular engine and make of vehicle. The constants are given values to adjust the predictive curve to fit experimentally determined data to a desired extent. A perfect fit is not required for a commercially useful equation.

In a preferred embodiment, a combination of material balance and isotherm equation is used to compute purge hydrocarbon concentration as a function of commanded purge volume. Commanded purge volume is computed from the purge valve pulse width modulation, or length of time that the purge valve is open. The isotherm-based model for predicting canister purge air and hydrocarbon flow uses a relationship that the amount of hydrocarbon purged from the evap canister equals the initial amount of hydrocarbon adsorbed in the evap canister when purging starts minus the final amount of hydrocarbon adsorbed in the evap canister after purging ends. The total amount of purge vapor sent to the engine is defined as $\Delta V$. The volume of carbon contained in the evap canister is $(1-\epsilon)V_c$, where $\epsilon$ is the porosity of the adsorbent (e.g., activated carbon) and $V_c$ is the evap canister volume. Using these relationships in an isotherm model, $$(1-\epsilon)V_c(Q)-(1-\epsilon)V_c(Q_1)=(\Delta VP)\div(RT)$$

and $$Q_1=Q_mB_bP\div(1+Q_mB_bP),$$

where $(1-\epsilon)V_c$ is the volume of the carbon in the evap canister,

Q is the initial adsorbed amount of hydrocarbon per unit volume of carbon, $\Delta V$ is the volume of purge vapor, $Q_1$ is the final adsorbed amount of hydrocarbon per unit volume of carbon after $\Delta V$ volume of purge vapor, R is the gas law constant, P is the partial pressure of the hydrocarbon vapor in the purge vapor, T is the air temperature in Kelvin, and $Q_m$ and $B_b$ are isotherm constants in which $Q_m$=A+B/T and $B_b$=EXP(C+D/T), with A, B, C, and D being characteristic constants of the adsorbent (e.g., the carbon) in the evap canister. For example, when the adsorbent is 15BWC carbon and the hydrocarbon is butane, A, B, C, and D are 0.00368, 0.365200, −8.6194, and 3102, respectively.

The equation may be rearranged into a quadratic equation to solve for P:

$$KB_bP^2+(K-QB_b+Q_mB_b)P-Q=0,$$

where $$K=(\Delta V)\div((1-\epsilon)V_cRT).$$

The quadratic equation is solved for P:

$$P=\frac{-b+\sqrt{b^2-4ac}}{2a}$$

where a=$KB_b$, b=$K-QB_b+Q_mB_b$, and c=−Q.

Correction factors are needed to account for the incomplete utilization of the adsorbent (e.g., carbon bed) and for partial fills. In most cases, even during fill ups of the fuel tank, only a part of the adsorbent in the evap canister is saturated with hydrocarbons. Some parts of the adsorbent bed may be partially saturated while other parts may remain clean to prevent breakthrough loss. Typically, only about 50% of a 2.1L canister adsorbent bed may be saturated with vapor after a complete refueling. The correction for the adsorbent utilization may be determined experimentally for the particular vehicle and equipment. In one example, correction factor $k_c$ for carbon utilization and correction factor $k_f$ for partial fill are included in an equation:

$$K=\Delta V/(k_ck_f(1-\epsilon)V_cRT).$$

A controller algorithm using the model may also take into account that usually during normal vehicle operation the concentration of purge hydrocarbon is less than about 5%. Further, for canister purging following one or two diurnal hydrocarbon vapor loadings of the evap canister at summer temperatures (temperatures greater than 50° F.), initial purge hydrocarbon concentration can be estimated to be about 10% and decrease slowly as purging continues. Diurnal hydrocarbon vapor loading of the evap canister at winter temperatures (less than 50° F.) is negligible. Finally, immediately after refueling an initial hydrocarbon vapor in the purge vapor can be estimated at about 35%, which decreases exponentially as purging continues. Vehicle refueling results in a nearly saturated, warm canister at both summer and winter ambient temperatures.

The algorithm may also take into account two exceptional conditions for butane loading of the evap canister and hot fuel handling. First, if refueling has not taken place (no fuel level change detected) but a vehicle oxygen sensor detects high purge hydrocarbon concentration at an ambient temperature less than about 90° F., then the algorithm may assume a butane-loaded canister in estimating decay of hydrocarbon concentration in the purge vapor with continued purging. Secondly, if refueling has not taken place (no fuel level change detected) but a vehicle oxygen sensor detects high purge hydrocarbon concentration at an ambient temperature of about 90° F. or higher, then the algorithm may assume a hot fuel handling situation (high fuel vapor pressure) in which there is little or no air in the purge vapor.

Returning now to the figures, FIGS. 2A and 2B together are a flow chart illustrating a preferred embodiment of the method by which the vehicle controller 14 estimates the amount of fuel vapor in the purge from the evaporative vapor storage container 62 using a preferred embodiment of a predictive model. Algorithm 100 begins with step 101 with engine start of the vehicle. At step 102, the controller (e.g., ECM or PCM) reads the engine soak time t (that is, how long it has been since the engine was last running), the fuel level F1 and ambient temperature TF1 at the end of the time the engine was last running (i.e., at the beginning of the soak or the end of the last trip), and the fuel level F2 and ambient temperature TF2 at the current engine start. At step 103 the controller makes a decision whether the engine start was a cold start—e.g., if t is more than about five hours. If the engine start was not a cold start, the algorithm proceeds to step 105 to treat the stop as a refueling stop. If the engine start was a cold start, the algorithm proceeds to step 104 and tests for a diurnal purge condition.

At step 104, the algorithm compares fuel level F1 to fuel level F2. If the fuel level has not changed, the algorithm assumes a diurnal purge condition. In the case of a diurnal purge, if TF1 and TF2 are less than about 50° F. the initial hydrocarbon concentration in the purge vapor ($C_{HC0}$) is set to zero; otherwise, the algorithm assumes an initial purge vapor with approximately 10% by volume hydrocarbon vapor and 90% by volume air, and the initial hydrocarbon concentration ($C_{HC0}$) is set to 10% by volume hydrocarbon vapor in the purge. If F2 is greater than F1, the algorithm assumes a refueling vapor purge in which the initial purge vapor will have approximately 10% by volume hydrocarbon vapor and 90% by volume air, and the initial hydrocarbon concentration ($C_{HC0}$) is set to 10% by volume hydrocarbon vapor in the purge. The algorithm then proceeds to step 109 to begin closed-loop fuel control.

If the algorithm determined at step 103 that the purge comes after refueling, then at step 105 the algorithm asks whether F2 is greater than F1 (fuel level has increased) and if the stopping time t is less than about 10 minutes. If these conditions are both met, then the algorithm moves to step 106, assumes 35% hydrocarbon vapor in the purge vapor, and sets $C_{HC0}$ to 35, and proceeds to step 108. If, on the other hand, refueling is followed by a soak period of t hours in which the canister has cooled, $C_{HC0}$ will be less than 35, and $C_{HC0}$ is estimated in step 107 to drop exponentially with time. $C_{HC0}$ may be estimated using the equation:

$$C_{HC0}=10+25\mathrm{EXP}(-0.9t)$$

The algorithm then proceeds to step 108. In step 108, the algorithm calculates a partial fill factor $k_f$ using F1 and F2, then moves on to step 109 to begin closed-loop fuel control.

In closed loop fuel control, the ECM or PCM uses oxygen sensor feedback for fuel control. Canister purge is enabled, or purging starts once the engine goes into closed loop operation. Proceeding now to step 109, the algorithm enters a closed-loop fuel control segment. In step 110, the algorithm determines whether it is possible to measure the initial fuel vapor concentration in the purge ($C_{HC0}$) intrusively. It is possible to measure intrusively if the engine is operating at a steady state (e.g., if the engine is at idle or cruising at constant speed). If $C_{HC0}$ can be measured intrusively, the algorithm proceeds to step 111; if it is not, the algorithm continues to step 114.

In step 111, the controller turns the canister purge off, then stores a value for either tank fuel consumption rate or the injector pulse width (INJPW1). In step 112 the canister purge is turned on, and the controller algorithm stores a second value for tank fuel consumption rate or injector pulse width (INJPW2) with canister purge on. Finally, in step 113, the initial purge hydrocarbon concentration $C_{HC0}$ is determined using the values of tank fuel consumption rate or injector pulse width that were determined in steps 112 and 113. The algorithm then continues to step 114.

At step 114, the algorithm computes the isotherm constants $Q_m$ and $B_b$ at air temperature T, where T is air temperature in kelvin. The algorithm also calculates the hydrocarbon vapor partial pressure P in the purge vapor by multiplying atmospheric pressure (which may be taken as 1 atmosphere) by the initial concentration fraction of hydrocarbon vapor in the purge vapor. Finally, $Q_m$, $B_b$, and P are used to calculate Q using the equation $Q=Q_mB_bP\div(1+Q_mB_bP)$. The algorithm then continues with step 115. In step 115, the algorithm computes the commanded purge volume $\Delta V$ from the purge valve PWM (pulse width modulation).

In step 116, the algorithm computes the purge vapor composition using the isotherm-based model described above. K is determined using the equation $K=(\Delta V)\div((1-\epsilon)V_cRT)$. The quadratic equation for pressure P is solved $$P=\frac{-b+\sqrt{b^2-4ac}}{2a}$$

where $a=KB_b$, $b=K-QB_b+Q_mB_b$, and $c=-Q$, and Q has the value determined in step 114. When P has been calculated, then the concentration fraction of hydrocarbon $C_{HC}$ in the purge vapor is determined from the ratio of its partial pressure P to the atmospheric pressure $P_{atm}$:

$$C_{HC}=P/P_{atm}$$

Finally, the algorithm computes purge hydrocarbon flow $\Delta VC_{HC}$ and purge air flow $\Delta V(1-C_{HC})$ in step 118 for engine fuel and air calculations.

Figure 3:
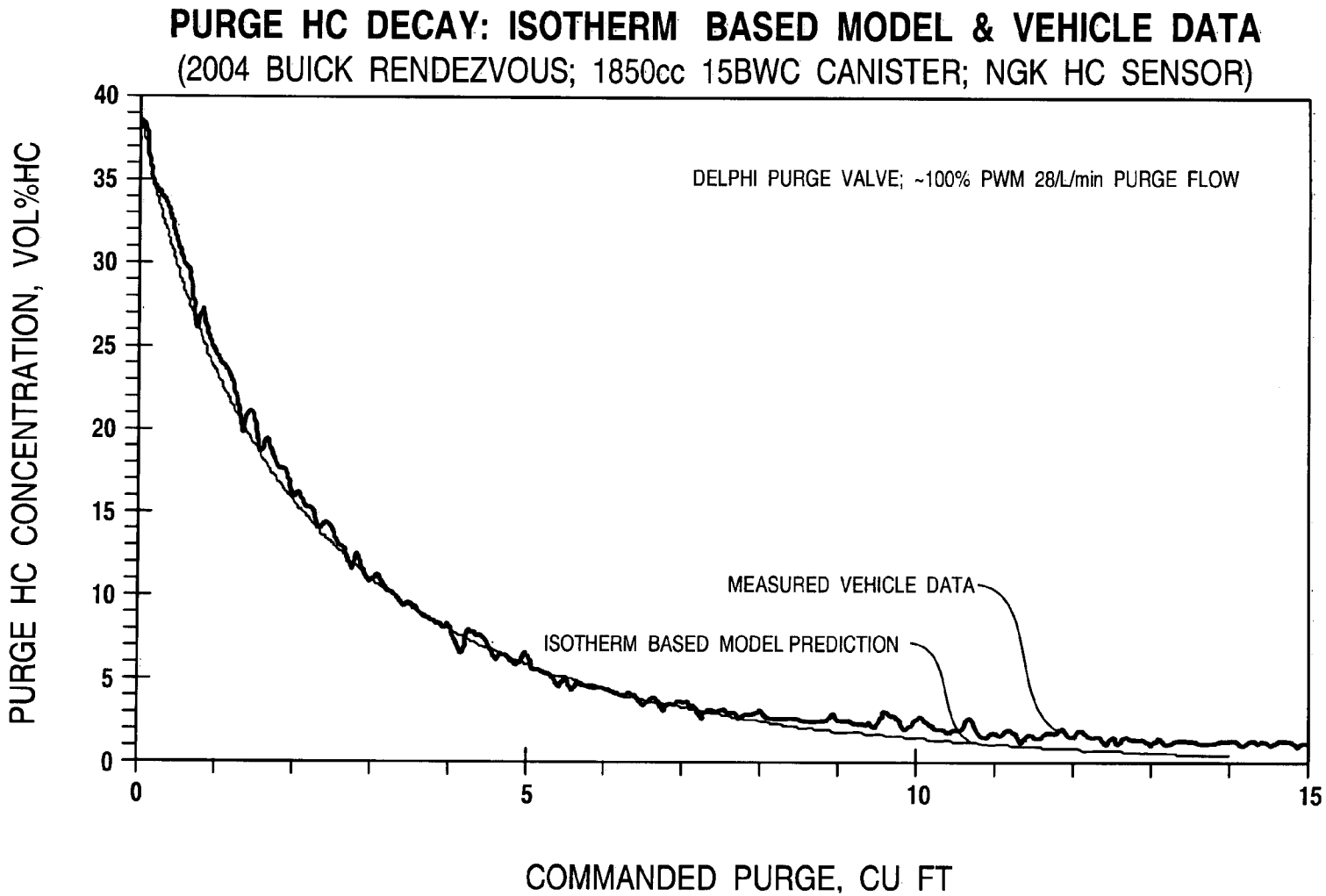
FIG. 3 is a graph showing measured and calculated purge hydrocarbon volume percents.

FIG. 3 is a graph showing measured and calculated purge hydrocarbon volume percents for a 2004 Buick Rendezvous having an 1850 cc evap canister containing 15BWC carbon. The hydrocarbon vapor is measured using an NGK hydrocarbon sensor. The vehicle used a Delphi purge valve having a 28L/min purge flow at 100% PWM (pulse width modulation). The data was taken following a refuel after a 10-mile city drive. The refuel was 14 gallons of fuel at an ambient temperature of 55° F. The vehicle was driven on the highway following the refuel, with purge hydrocarbon concentration being measured as a functional of cubic feet of commanded purge. A curve showing the isotherm-based model prediction shows a close fit to the experimentally determined data.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for controlling amounts of air and fuel introduced to an engine during purge of hydrocarbon vapor from a canister containing adsorbed hydrocarbon vapor, comprising the steps of:

providing an initial value, $C_{HC0}$, for the concentration of hydrocarbon vapor in the canister containing adsorbed hydrocarbon vapor;

drawing air into the canister containing adsorbed hydrocarbon vapor and withdrawing from the canister a volume of purge vapor containing desorbed hydrocarbon vapor;

calculating a concentration of desorbed hydrocarbon vapor in the purge vapor; and using purge vapor volume and concentration of desorbed hydrocarbon vapor in the purge vapor to calculate the amounts of purge hydrocarbon vapor and purge air and adjusting an amount of fuel to be taken from the fuel tank and an amount of intake air based on the amounts of purge hydrocarbon vapor and purge air.

2. A method for controlling amounts of air and fuel introduced to an engine during purge of hydrocarbon vapor from a canister containing adsorbed hydrocarbon vapor according to claim 1, wherein $C_{HC0}$ is measured by monitoring the fuel injection rate with and without canister purge at steady state engine operation.

3. A method for controlling amounts of air and fuel introduced to an engine during purge of hydrocarbon vapor from a canister containing adsorbed hydrocarbon vapor according to claim 1, wherein $C_{HC0}$ is estimated from purge canister and/or vehicle conditions.

4. A method for controlling amounts of air and fuel introduced to an engine during purge of hydrocarbon vapor from a canister containing adsorbed hydrocarbon vapor according to claim 1, wherein the concentration of desorbed hydrocarbon vapor in the purge vapor is calculated using a curve fitted to experimentally measured values for hydrocarbon concentration in the purge vapor as a function of commanded purge vapor volume for a specific vehicle, purge canister, absorbent, and purge conditions.

5. A method for controlling amounts of air and fuel introduced to an engine during purge of hydrocarbon vapor from a canister containing adsorbed hydrocarbon vapor according to claim 1, wherein the concentration of desorbed hydrocarbon vapor in the purge vapor is calculated using a model that predicts exponential decrease for hydrocarbon concentration in the purge vapor from the initial hydrocarbon concentration with continuing purge.

6. A method for controlling amounts of air and fuel introduced to an engine during purge of hydrocarbon vapor from a canister containing adsorbed hydrocarbon vapor according to claim 1, wherein the concentration of hydrocarbon in the purge vapor, $C_{HC}$, is calculated from an equation:

$$C_{HC}=C_{HC0}\mathrm{EXP}(-(\alpha C_{HC0}+\beta)V), \text{ in which}$$

V is the cubic feet of commanded purge volume;

$C_{HC0}$ is the initial concentration of hydrocarbon vapor in the purge;

$C_{HC}$ is the concentration of hydrocarbon vapor in the purge after V cubic feet of commanded purge volume; and $\alpha$ and $\beta$ are constants, the values of which depend on the particular-engine and make of vehicle.

7. A method for controlling amounts of air and fuel introduced to an engine during purge of hydrocarbon vapor from a canister containing adsorbed hydrocarbon vapor according to claim 1, wherein the concentration of hydrocarbon in the purge vapor, $C_{HC}$, is calculated using a model combining material balance and isotherm equations.

8. A method for controlling amounts of air and fuel introduced to an engine during purge of hydrocarbon vapor from a canister containing adsorbed hydrocarbon vapor according to claim 1, wherein the concentration fraction of hydrocarbon $C_{HC}$ in the purge vapor is determined from a ratio of its partial pressure P to the atmospheric pressure $P_{atm}$, using the equation $$C_{HC}=P/P_{atm},$$

wherein $$P=\frac{-b+\sqrt{b^2-4ac}}{2a}$$

wherein $a=KB_b$, $b=K-QB_b+Q_mB_b$, and $c=-Q$, and $K=\Delta V/(K_cK_f(1-\epsilon)V_cRT)$ where $\Delta V$ is the volume of purge vapor, $k_c$ is a correction factor for carbon utilization, $k_f$ is a correction factor for partial fill, $(1-\epsilon)V_c$ is the volume of the carbon in the evap canister, $\epsilon$ is the porosity of the adsorbent in the evap canister, and $V_c$ is the evap canister volume, R is the gas law constant, and T is the air temperature in Kelvin, Q is the initial adsorbed amount of hydrocarbon per unit volume of carbon, $Q_1$ is the final adsorbed amount of hydrocarbon per unit volume of carbon after $\Delta V$ volume of purge vapor wherein $Q_1=Q_mB_bP\div(1+Q_mB_bP)$, and $Q_m$ and $B_b$ are isotherm constants in which $Q_m=A+B/T$ and $B_b=\mathrm{EXP}(C+D/T)$, with A, B, C, and D being characteristic constants of the adsorbent in the evap canister.

9. A method of operating a vehicle having an internal combustion engine with an air induction system, a fuel tank connected to the engine to supply fuel to the engine, an electronic engine control module comprising a programmed microprocessor controlling fuel delivery to the engine and intake air to the engine, and a canister to adsorb vapor from the fuel tank comprising a vapor inlet coupled to the fuel tank and a purge outlet coupled to the air induction system, comprising steps of:

adsorbing fuel vapor from the fuel tank into the canister through the vapor inlet;

desorbing fuel vapor from the canister through the purge outlet by opening the purge valve through a signal from the electronic engine control module and drawing air through the canister into the air induction system;

calculating the concentration of desorbed hydrocarbon vapor in the purge vapor;

using the concentration of desorbed hydrocarbon vapor and purge vapor volume to calculate the amounts of purge hydrocarbon vapor and purge air and using the electronic engine control module to adjust fuel delivery from the fuel tank to the engine and/or the amount of intake air in response to the calculated amounts of purge hydrocarbon vapor and purge air.

10. An engine controller having an algorithm for determining the concentration of hydrocarbon vapor in purge vapor drawn from a canister containing adsorbed hydrocarbon vapor, said algorithm including steps for providing an initial concentration of hydrocarbon in purge vapor;

steps for determining commanded purge volume and purge vapor composition; and steps for calculating purge air correction and purge hydrocarbon correction and applying the corrections in engine air and fuel intake calculations;

wherein the controller is adapted to apply the corrections in engine air and fuel intake calculations to adjust the amount of air and fuel taken into an engine.

11. A controller according to claim 10, wherein the purge vapor composition is determined using a curve fitted to experimentally measured values for hydrocarbon concentration in the purge vapor as a function of commanded purge vapor volume for a specific vehicle, purge canister, absorbent, and purge conditions.

12. A controller according to claim 10, wherein the purge vapor composition is determined using a model that predicts exponential decrease for hydrocarbon concentration in the purge vapor from the initial hydrocarbon concentration with continuing purge.

13. A controller according to claim 10, wherein the purge vapor composition is determined using a model combining material balance and isotherm equations.

14. A vehicle having an internal combustion engine with an air induction system, a fuel tank connected to the engine to supply fuel to the engine, an electronic engine control module comprising a programmed microprocessor controlling fuel and air delivery to the engine, and a canister to adsorb vapor from the fuel tank comprising a vapor inlet coupled to the fuel tank, a purge outlet coupled to the air induction system, and an air inlet, wherein the microprocessor is programmed to estimate concentration of hydrocarbon vapor in purge air drawn through the air inlet, through the canister, and through the purge outlet from the canister from an equation that predicts a decrease of fuel vapor concentration in the purge air from an initial fuel vapor concentration in the purge air and further wherein the electronic engine control module adjusts fuel and air delivery to the engine in response to the estimated concentration of hydrocarbon vapor in the purge air.

15. A vehicle according to claim 14, wherein the equation predicts exponential decrease for hydrocarbon concentration in the purge vapor from the initial hydrocarbon concentration with continuing purge.

16. A vehicle according to claim 14, wherein the equation combines material balance and isotherm equations.

* * * * *